US006475047B2

(12) United States Patent
Cynamon

(10) Patent No.: US 6,475,047 B2
(45) Date of Patent: Nov. 5, 2002

(54) RESCUE DEVICE

(76) Inventor: Sam Cynamon, 517 Wyoming Ave., Millburn, NJ (US) 07041

( * ) Notice: Subject to any disclaimer, the term of this patent is extended or adjusted under 35 U.S.C. 154(b) by 0 days.

(21) Appl. No.: 09/785,941

(22) Filed: Feb. 16, 2001

(65) Prior Publication Data

US 2001/0024916 A1 Sep. 27, 2001

Related U.S. Application Data

(60) Provisional application No. 60/183,353, filed on Feb. 18, 2000.

(51) Int. Cl.[7] ..... B63C 9/08; B63C 9/26

(52) U.S. Cl. ..... 441/80; 441/88; 441/108; 441/84

(58) Field of Search ..... 441/80, 88, 108, 441/123, 127, 129, 106, 113–119, 65, 84

(56) References Cited

U.S. PATENT DOCUMENTS 3,179,397 A * 4/1965 Cleereman et al. ..... 114/219
3,216,030 A * 11/1965 Garfield ..... 134/169 A
3,317,936 A * 5/1967 Johnson et al. ..... 242/378.4
3,925,839 A * 12/1975 Smith ..... 2/2.15
4,523,913 A * 6/1985 Kaino ..... 441/81
5,480,332 A * 1/1996 Cynamon ..... 441/80
5,617,808 A * 4/1997 Robinson ..... 114/123
5,636,900 A * 6/1997 Wilkie et al. ..... 297/284.3
5,851,339 A * 12/1998 Rucker ..... 156/290
5,878,685 A * 3/1999 Hemphill et al. ..... 114/219
6,257,163 B1 * 7/2001 Carpenter ..... 114/253

* cited by examiner

*Primary Examiner*—Sherman Basinger
(74) *Attorney, Agent, or Firm*—Robert P. Michal; Frishauf, Holtz, Goodman & Chick, P.C.

(57) ABSTRACT

An improved rescue device includes a floatation material, a flexible mesh disposed about the floatation material wherein the flexible mesh is in contact with an outer surface of the floatation material, and a bonding material covering the flexible mesh and the floatation material. The floatation material is a closed cell foam material, the flexible mesh is a nylon mesh, and the bonding material is a polyvinyl chloride paint. The rescue device may also include a tow line affixed to one end thereof and a plurality of rings arranged along the length of the tow line. A harness may be coupled to one end of the tow line and a securement device may be coupled to the tow line to retain the tow line in a compressed state. The securement device may be a collar which fastens upon itself by hook and loop fasteners.

25 Claims, 2 Drawing Sheets

RESCUE DEVICE

CROSS REFERENCE TO RELATED APPLICATION

This application claims priority under 35 USC 119(e) of Provisional Application Ser. No. 60/183,353 filed Feb. 18, 2000 entitled "Super Rescue Tube", the entire disclosure of which is incorporated herein by reference.

FIELD OF THE INVENTION

The present invention relates to flotation devices for use in an aquatic environment.

BACKGROUND INFORMATION

Many flotation devices are known and used by life guards to rescue drowning victims and to assist persons who may have difficulty swimming. Known rescue devices such as life saving rings and tubes include a foam-type material having excellent buoyancy. The foam material is typically covered with a vinyl paint to prevent deterioration of the foam due to sun exposure and surface abrasions. A neoprene cover may be provided over the painted foam material to provide extra protection to the flotation device. For rescue tubes, the neoprene cover is similar to a tube in that it is open at both ends. The neoprene cover is guided over the painted foam material so that the cover is secured about the rescue tube. The neoprene cover is typically fitted securely about the rescue tube such that the cover cannot move.

The neoprene cover does not, however, provide a water tight seal around the foam and thus permits water to contact the painted foam material when the device is exposed to water. Moisture typically becomes trapped between the neoprene cover and the painted surface of foam material. This causes mold and mildew to grow between the neoprene cover and the painted foam. Moreover, the vinyl paint will crack whether or not the neoprene cover is present and allow water to contact the foam material which can result in deterioration of the foam material. Thus the prior art rescue devices must be periodically replaced to insure their structural integrity.

OBJECTS AND SUMMARY OF THE INVENTION

It is therefore an object of the present invention to provide an improved rescue device which prevents water from contacting the inner foam material.

It is another object of the present invention to provide an improved rescue device which prevents the foam from splitting or cracking.

It is yet another object of the present invention to provide an improved rescue device having a textured surface which enables a user to securely handle the rescue device even when the device is wet.

It is a further object of the present invention to provide an improved rescue device which can be bent and twisted without breakage and which is durable.

It is yet a further object of the present invention to provide an improved rescue device which overcomes the inherent disadvantages of known rescue devices.

In accordance with the present invention, an improved rescue device includes a floatation material, a flexible mesh disposed about the floatation material wherein the flexible mesh is in contact with an outer surface of the floatation material, and a bonding material covering the flexible mesh and the floatation material. The floatation material may be a closed cell foam material, the flexible mesh may be a nylon mesh, and the bonding material may be a polyvinyl chloride (PVC) paint. The rescue device may also include a tow line affixed to one end thereof and a plurality of rings arranged along the length of the tow line. An adjustable harness may be coupled to one end of the tow line and a securement device may also be included to retain the tow line in a compressed state. The securement device may be a collar or strap which fastens upon itself by hook and loop fasteners.

These and other objects, features and advantages of the present claimed invention will become readily apparent from the following detailed description thereof, which is to read in connection with the accompanying drawings.

DETAILED DESCRIPTION OF THE PREFERRED EMBODIMENT

Figure 1:
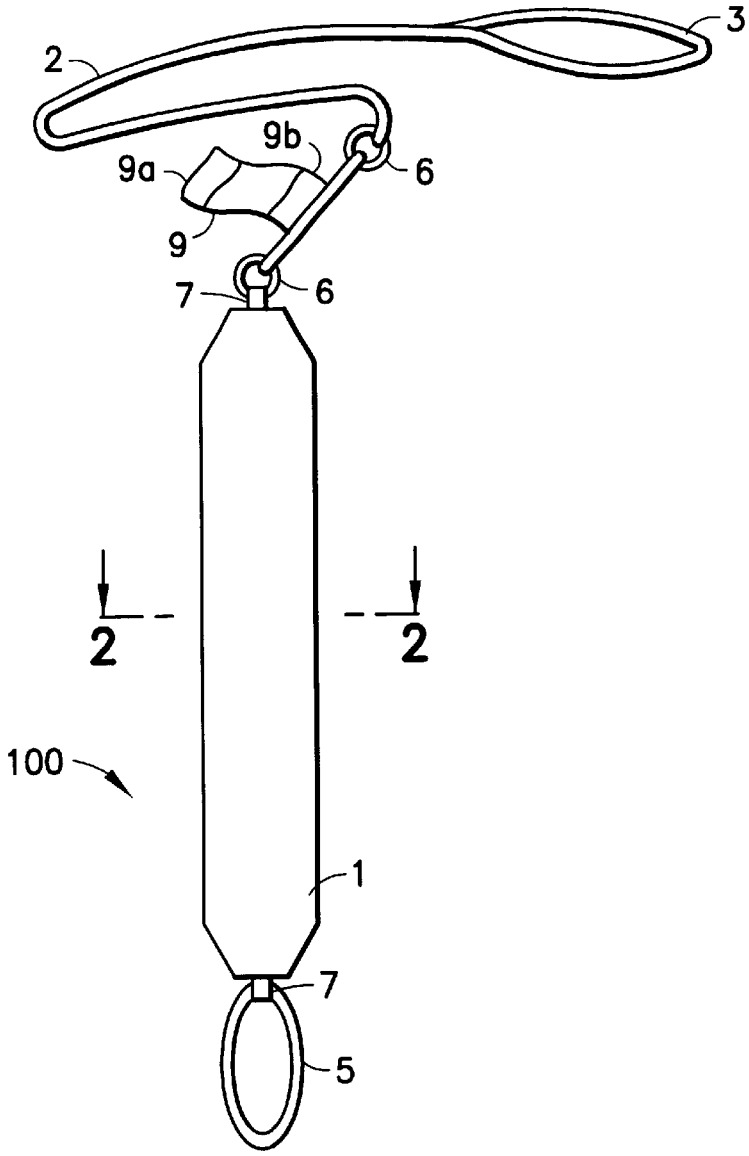
FIG. 1 is a top view of the improved rescue device of the present invention.
Figure 3:
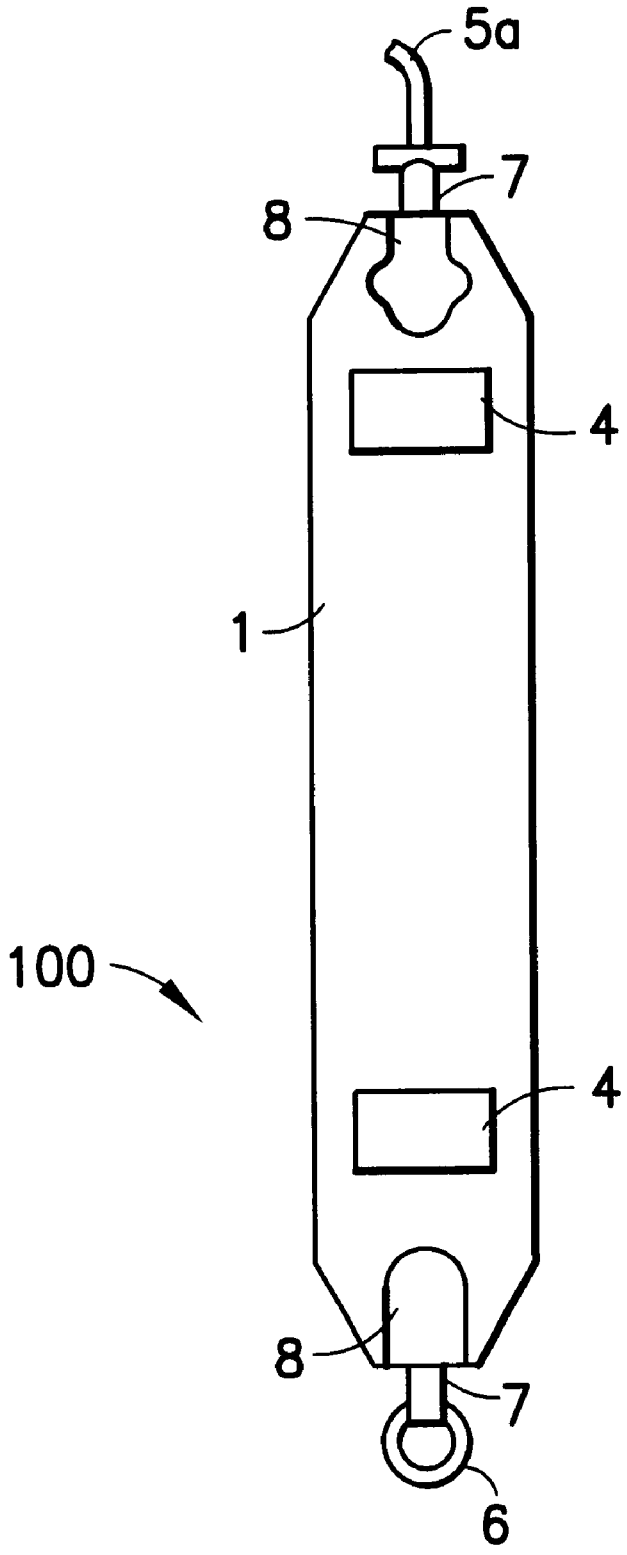
FIG. 3 is top view of an alternative embodiment of the improved rescue device of FIG. 1.

Referring now to the drawings, the improved rescue device 100 includes an elongate member 1, the core of which is a flotation material such as a closed-cell foam material. A closed cell foam material is preferred because this type of foam does not absorb water. At one end of the elongate member, a tow rope 2 with an adjustable harness 3 is connected. While FIG. 1 shows a ring 6 interposed between the tow line 2 and the elongate member 1, the tow line 2 can be directly coupled to the elongate member. The harness is adjustable by means of a buckle (not shown) or other suitable adjustment device. A rescuer can adjust the size of the opening of the harness to secure the harness around his body and pull the elongate member while swimming to a person in need of assistance. The elongate member may include a fastener 4 (see FIG. 3) such as a hook and loop fastener (Velcro®) on any one of its surfaces for securing a plurality of elongate members (rescue devices) together such as that taught in U.S. Pat, No. 5,480,332 to Cynamon, the entire disclosure of which is incorporated herein by reference.

The elongate member 1 includes at the end opposite the tow line a reach assist loop 5 (a strap sewn into a loop) which enables a person in need of assistance to securely grab the rescue device when provided by a rescuer. The elongate member may also include a hook 5*a* (see FIG. 3) or ring 6 for attaching a plurality of elongate members end to end (as opposed to the side to side fastening with the hook and loop fastener 4 described above). The hook and ring of the same rescue tube may also be coupled to one another by the rescuer such that the rescue device encircles the body of the person in need of assistance to support the person in the water. A cord or strap 7 runs longitudinally through the center of the elongate member (from one end of the member to the other) to provide added strength to the reach assist loop/hook/ring assembly such that the reach assist loop, hook or ring could not readily become dislodged from the elongate member. Alternatively, internal anchors can be secured within the elongate member and attached to each strap which exits the elongate member to prevent the strap from becoming dislodged therefrom.

In the alternative embodiment (see FIG. 3), the elongate member 1 includes near its end regions proximate the rings 6 and hooks 5, recesses 8 molded into the body of the member so as to accommodate the rings and hooks when in an unused state. As mentioned above, the rings and hooks permit a plurality of rescue devices to be attached end to end to form a chain, or in the alternative a single member can be attached to itself so as to form a ring. The hook and ring can be manually pushed into the recess when not in use or a recoiling device (not shown) can be provided to automatically retract the hook or ring into the recess.

Referring again to FIG. 1 the improved rescue device 100 also preferably includes a securing strap 9 attached to the tow line 2. When the tow line is folded upon itself such that it is in a compressed state (e.g., in a coil), the tow line can be maintained in the compressed state by wrapping the securing strap around the coiled tow rope. This prevents the tow rope from being dragged on the ground and possibly tripping a rescuer who is carrying the rescue device when entering the water to assist a swimmer. While the rescuer enters the water, the securing strap 9 can be readily unsecured to release the tow line 2 from its compressed state so that the harness 3 can be secured around the rescuer. The securing strap preferably includes hook and look fasteners 9*a*, 9*b* (e.g. Velcro®) for securing the tow line. Other suitable means of securement such as a snap or button can be employed.

Figure 2:
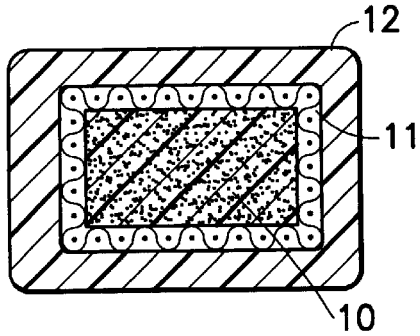
FIG. 2 i a cross-section of the improved rescue device of FIG. 1 taken along line 2—2.

Referring now to FIG. 2, a cross-section of the elongate member 1 taken along lines 2—2 of FIG. 1 is shown. The elongate member preferably includes a closed-cell foam material 10 such as ensolite PVC closed-cell foam manufactured by Rubertex Corporation as product no. MLC. Other closed-cell foams or buoyant materials which do not absorb water can be employed. While open-cell foam can also be employed, closed-cell foam is preferred. The device also includes a flexible mesh 11 disposed about the foam material and in contact with the outer surface of the foam material. The mesh has a substantially open cell configuration (diamond or square shape configuration). A suitable flexible mesh is a nylon tubular gauze with about a 12.5" stretch such as type 6 nylon tubular gauze manufactured by Jefferson Mills and distributed by Carolina Narrow Fabric Company as product no. 72125. Other flexible meshes made of materials other than nylon, such as cotton, rayon, Kevlar, etc., and having a tighter or looser weave can be employed if they have suitable strength so as not to break when covered with the bonding material (described below) and when the finished product is bent and twisted.

The flexible mesh is secured about the foam material by any suitable means such as sewing, gluing or knotting the ends. It is important to note that the flexible mesh should be stretched over the foam material prior to securement so that the flexible mesh cannot freely move and rotate about the foam material. However, stretching the flexible mesh too tightly may cause the mesh fibers to break during use of the rescue tube. The flexible mesh should be not stretched such that there is a void between the mesh and foam material. Instead, the mesh should contact the foam material. It is preferable that the mesh is secured directly to the straps that exit the ends of the elongate members (see FIG. 1) so as to assist in preventing separation of the foam from the strap during use.

The rescue device also includes a bonding material 12 applied over the flexible mesh and foam material. The bonding material is preferably of a sufficient thickness (about 0.01 inch) to coat the foam material and flexible mesh to secure the flexible mesh to the foam material. The bonding material is preferably a polyvinyl chloride (PVC) paint which is flexible and which will not crack when the rescue device is bent into various shapes such as to form a ring. A suitable polyvinyl chloride paint is Part No. 457 dry blend PVC paint manufactured by Flexabar Corp. Methyl ethyl ketone and toluene are solvents which are mixed with the dry blend material, in the ratio of 45 methyl ethyl: 35 toluene: 20 dry blend PVC paint to make the liquid paint to apply to the foam material and mesh. Other PVC paints may be used. In addition, other paints instead of PVC paint can be used. The paint that is used should be flexible when dry so that the rescue device can be bent and twisted without cracking the paint. Polyurethane may also be used.

While the present invention has been described above in connection with a rescue tube, the floatation material can be any shape such as a life vest, life saving can, life preserver, "noodle" or floating ring. It should also be noted that the bonding material is preferably applied in a limited amount (only to apply a thin coat) so that the mesh material extends above the surface of the bonding material such that the mesh provides a texture to the surface of the rescue device to assist users in better handling the rescue device in the water where the rescue tube can be slippery. The flexible mesh is advantageous because it gives strength to the foam to prevent splitting and cracking when bent into different shapes for various uses.

Having described specific embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims. For example, while the flexible mesh is explained above as surrounding the floatation material, it is foreseen that the mesh can be applied to individual surfaces to provide strength and texture only to a particular surface.

What is claimed is:

1. A rescue device comprising:

a floatation material;

a flexible mesh disposed entirely about said floatation material, said flexible mesh being in contact with an outer surface of said floatation material; and a bonding material covering the flexible mesh and the floatation material, wherein the rescue device is sufficiently flexible and includes first and second ends, the first end of the rescue device being disposable proximate the second end of the rescue device to at least partially encircle at least a portion of the body of a person in water to support the person in the water.

2. The rescue device according to claim 1, wherein the floatation material is a closed-cell foam material.

3. The rescue device according to claim 1, wherein the flexible mesh is made from one of nylon, cotton, rayon and Kevlar.

4. The rescue device according to claim 1, wherein the bonding material is one of a paint or polyurethane.

5. The rescue device according to claim 4, wherein if the bonding material is a paint, the paint is a polyvinyl chloride paint.

6. The rescue device according to claim 1, further comprising a tow line having first and second ends and a length, the first end of the tow line being coupled to one end of the rescue device.

7. The rescue device according to claim 6, wherein the tow line has a plurality of rings arranged along its length.

8. The rescue device according to claim 6, further comprising a harness coupled to the second end of the tow line.

9. The rescue device according to claim 6, wherein the flexible mesh is secured to the tow line.

10. The rescue device according to claim 6, further comprising a securement device to retain the tow line in a compressed state.

11. The rescue device according to claim 10, wherein the securement device comprises a strap.

12. The rescue device according to claim 11, wherein the strap fastens upon itself by one of hook and loop fasteners, snap and button.

13. The rescue device according to claim 10, wherein the securement device is coupled to the tow line.

14. The rescue device according to claim 1, further comprising at least one of a harness and hook coupled to one end of the rescue device.

15. The rescue device according to claim 1, wherein the rescue device has one of a rectangular, circular, elliptical and triangular cross-section.

16. The rescue device according to claim 1, wherein the rescue device further comprising a tow line having first and second ends and a length, the first end of the tow line being coupled to the first end of the rescue device, the tow line having a plurality of rings arranged along its length, and a hook coupled to the second end of the rescue, device for securement to at least one of the plurality of rings.

17. The rescue device according to claim 1, wherein the bonding material is of sufficient thickness to coat the floatation material and flexible mesh to secure the flexible mesh to the floatation material.

18. The rescue device according to claim 1, wherein the bonding material has a thickness such that the flexible mesh provides a texture to the surface of the rescue device.

19. The rescue device according to claim 1, further comprising a reach assist strap coupled to the floatation material.

20. The rescue device according to claim 19, wherein the flexible mesh is coupled to the reach assist strap.

21. A rescue device comprising:

a floatation material;

a flexible mesh disposed about said floatation material, said flexible mesh being in contact with an outer surface of said floatation material;

a bonding material covering the flexible mesh and the floatation material; and a tow line having first and second ends and a length, the first end of the tow line being coupled to one end of a otrap with exits and end the rescue device, and the flexible mesh being secured directly to the otrap.

22. A rescue device comprising:

a floatation material;

a flexible mesh disposed about said floatation material, said flexible mesh being in contact with an outer surface of said floatation material;

a bonding material covering the flexible mesh and the floatation material;

a tow line having first and second ends and a length, the first end of the tow line being coupled to one end of the rescue device; and a securement device to retain the tow line in a compressed state, wherein the rescue device is sufficiently flexible and includes first and second ends, the first end of the rescue device being disposable proximate the second end of the rescue device to at least partially encircle at least a portion of the body of a person in water to support the person in the water.

23. The rescue device according to claim 22, wherein the securement device comprises a strap.

24. The rescue device according to claim 23, wherein the strap fastens upon itself by one of hook and loop fasteners, snap and button.

25. rescue device according to claim 22, wherein the securement device is coupled to the tow line.

* * * * *